US006776167B1

(12) United States Patent
Gillispie

(10) Patent No.: US 6,776,167 B1
(45) Date of Patent: Aug. 17, 2004

(54) SPENT-CIGARETTE RESPOSITORY WITH DETACHABLE COLUMN

(75) Inventor: John G. Gillispie, Wheeling, WV (US)

(73) Assignee: Eagle Manufacturing Company, Wellsburg, WV (US)

( * ) Notice: Subject to any disclaimer, the term of this patent is extended or adjusted under 35 U.S.C. 154(b) by 26 days.

(21) Appl. No.: 10/302,020

(22) Filed: Nov. 22, 2002

(51) Int. Cl.[7] ..... A24F 19/00; A24F 21/00

(52) U.S. Cl. ..... 131/231; D27/124; 220/576; 206/246

(58) Field of Search ..... 206/246, 223; D27/122, 123, 124, 107, 106; 220/576; 285/305, 321; 131/231; 362/431; 232/43.1, 43.5, 43.2

(56) References Cited

U.S. PATENT DOCUMENTS

| | | | | | |
|---|---|---|---|---|---|
| 1,240,098 | A | | 9/1917 | Sweeney | |
| 1,646,086 | A | | 10/1927 | Fleming | |
| 1,646,099 | A | | 10/1927 | Mitchell | |
| 1,662,171 | A | | 3/1928 | Savery | |
| 1,670,525 | A | * | 5/1928 | Savery | 232/43.2 |
| RE17,500 | E | * | 11/1929 | Stevenson et al. | 232/43.2 |
| 1,807,079 | A | * | 5/1931 | Willmanns | 232/43.2 |
| 2,110,773 | A | * | 3/1938 | Nelson | 232/43.2 |
| D120,273 | S | * | 4/1940 | Meyer | D27/123 |
| 2,452,219 | A | | 10/1948 | Bergvall et al. | 285/193 |
| 2,567,166 | A | | 9/1951 | Dick | 232/43.3 |
| 4,142,537 | A | | 3/1979 | Fenelon | 131/240 |
| 4,441,745 | A | | 4/1984 | Nicholas | 285/417 |
| 4,696,497 | A | * | 9/1987 | Schwarzensteiner | 285/307 |
| 4,711,472 | A | | 12/1987 | Schnell | 285/162 |
| D389,600 | S | | 1/1998 | Luedecke | D27/118 |
| 5,725,257 | A | | 3/1998 | Sakane et al. | 285/81 |
| 5,924,425 | A | | 7/1999 | Luedecke | 131/231 |
| 5,988,704 | A | | 11/1999 | Ryhman | 285/307 |

* cited by examiner

*Primary Examiner*—Dionne A. Walls
(74) *Attorney, Agent, or Firm*—Armstrong, Kratz, Quintos, Hanson & Brooks, LLP

(57) ABSTRACT

A molded plastic repository for spent smoking materials having separate base and column pieces with connecting portions which are connected for use by a connector which engages the connecting portions. The base and column are molded as a single piece then severed in a plane so as to provide similar connecting portions in relation to the severing plane. The method of fabricating and assembly provides a savings in storing and shipping the repository.

6 Claims, 7 Drawing Sheets

SPENT-CIGARETTE RESPOSITORY WITH DETACHABLE COLUMN

FIELD OF THE INVENTION

The present invention relates to portable repositories for depositing spent smoking materials.

BACKGROUND OF THE INVENTION

Because of the significant public opposition to smoking, as well as laws prohibiting smoking in many public facilities as well as corporate offices, smokers often find it necessary to dispose of a cigarette prior to entering a building. Also, because of restrictions to smoking in work places, restaurants, and the like, designated locations, where smoking is permitted, are often provided for smokers to fulfill their desire to have a smoke. In order to maintain such areas free of cigarette "butts" and to guard against a potential fire hazard, operators of public buildings, offices, restaurants, and the like often provide spent-cigarette repositories at entrances to such facilities. For the convenience of moving such repositories, for example for storage during non-operating hours of the day or on weekends, portable repositories are usually preferred.

Decorative and functionally convenient portable repositories are described in U.S. Design Pat. No. DES. 389,600 and U.S. Design patent application Ser. No. 29/158,244, which is assigned to the same Assignee as the present application. Both of those repositories feature a broad base having an upwardly extending slender column, with at least one opening to the interior of the repository disposed near the top of the column, so as to be at a convenient height for users. A non-flammable material, such as sand, or the like, can be placed in the base in order to promote extinguishing of the burning tobacco, and also to add weight at the base in order to provide a more stable repository. Plastic is a desirable material for fabricating such repositories as it is durable, easily cleaned and resistant to corrosion in often moist conditions, and molds can be provided for forming the plastic material into attractive shapes with accenting features, so as not to detract from a formal entrance to a building, for example. Also a variety of colors can be provided to the repositories which are carried through the total thickness of the molded walls so that scratches or nicks are nearly invisible thereby presenting an attractive appearance. Although plastic is a preferred material, other materials are available for forming the repository.

The above-described shape, that is a broad base and an upwardly extending column, although an attractive design, does not lend itself to packaging in a compact manner for shipping, or storage, when the repository is formed as a single piece. A hexahedron shaped carton to accommodate the described repository must have a cross section to accommodate the broad base which extends the entire height of the repository. A large portion of the volume of the carton is unoccupied by the repository. Such inefficient usage of storage or shipping cartons add to the cost associated with producing, inventorying, and shipping the product.

OBJECTS OF THE INVENTION

It is an object of the invention to provide a spent-cigarette repository having a column which is detachable from the broad base, so as to be able to provide more compact and efficient packaging for storage and shipping.

It is another object of the invention to provide a connecting means which provides a sturdy connection between the broad base and the column.

It is yet a third object of the invention to provide a method of forming the repository of a plastic material so as to reduce the number of molding operations required for producing the repository.

SUMMARY OF THE INVENTION

The present invention is a repository for spent smoking materials having a base for supporting the repository in a freestanding upright orientation on a horizontal surface and a hollow column for extending upwardly from the base. The hollow column is a separate piece from the base piece. A connector slidingly engages the base piece and the column piece so as to connect those pieces in a rigid manner. The connector slidingly engages connecting portions of the base and the column, which abut against each other. The connecting portions are mirror images of each other in a plane between the base connecting portion and the column connecting portion. Each of the connecting portions has engaging sections for engaging with mating engaging sections provided on the connector.

In a method for fabricating the repository, the base and column are molded as a single piece, then the single piece is severed at a plane so as to provide the connecting portions on the base and on the column. The connecting portions have a mirror image of each other in the plane in which severing takes place.

BRIEF DESCRIPTION OF THE DRAWINGS

The invention will become more readily apparent from the following description of a preferred embodiment thereof shown, by way of example only, in the accompanying drawings, wherein.

DETAILED DESCRIPTION

Figure 1:
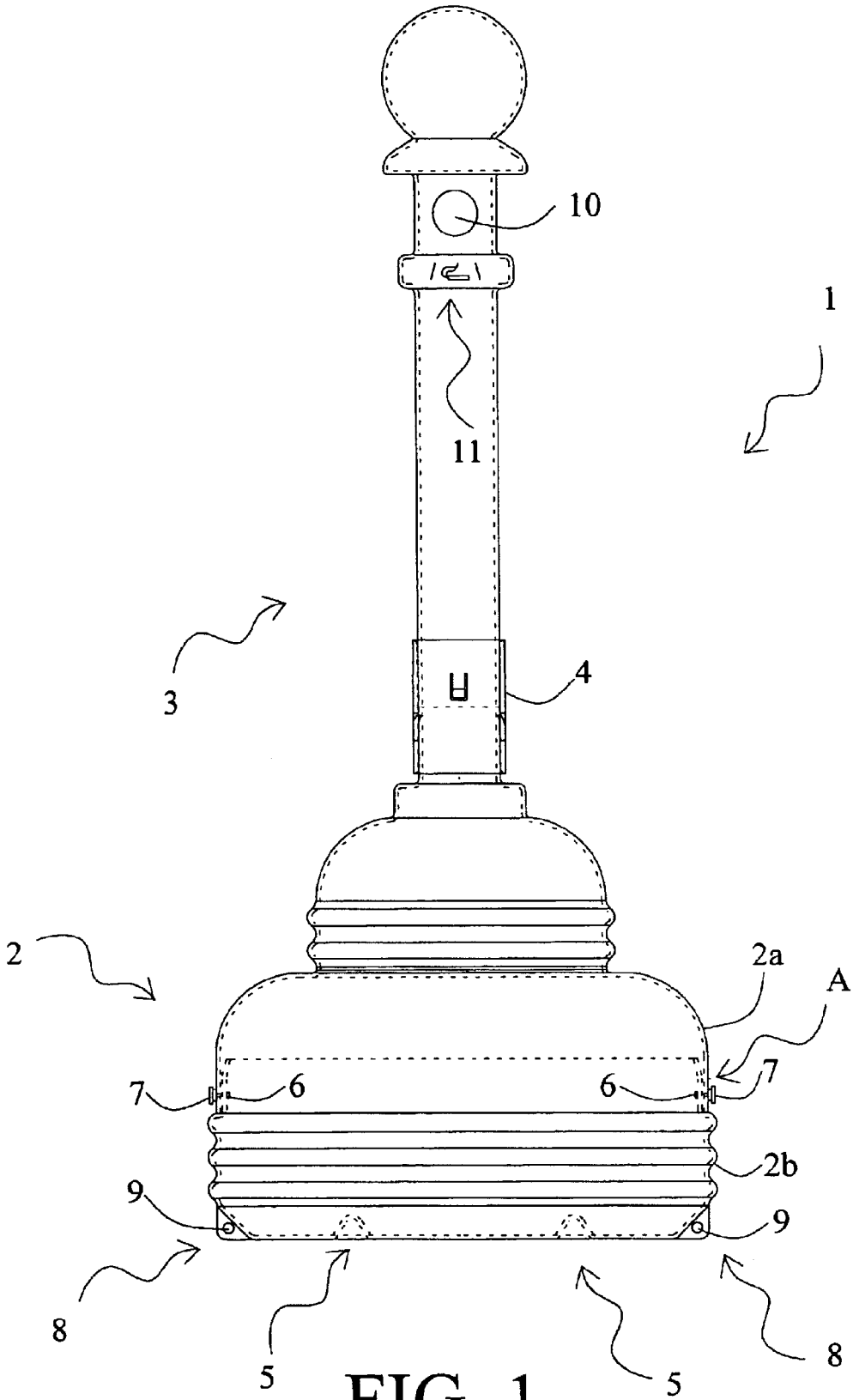
FIG. 1 is a front view of the repository of the present invention.
Figure 2:
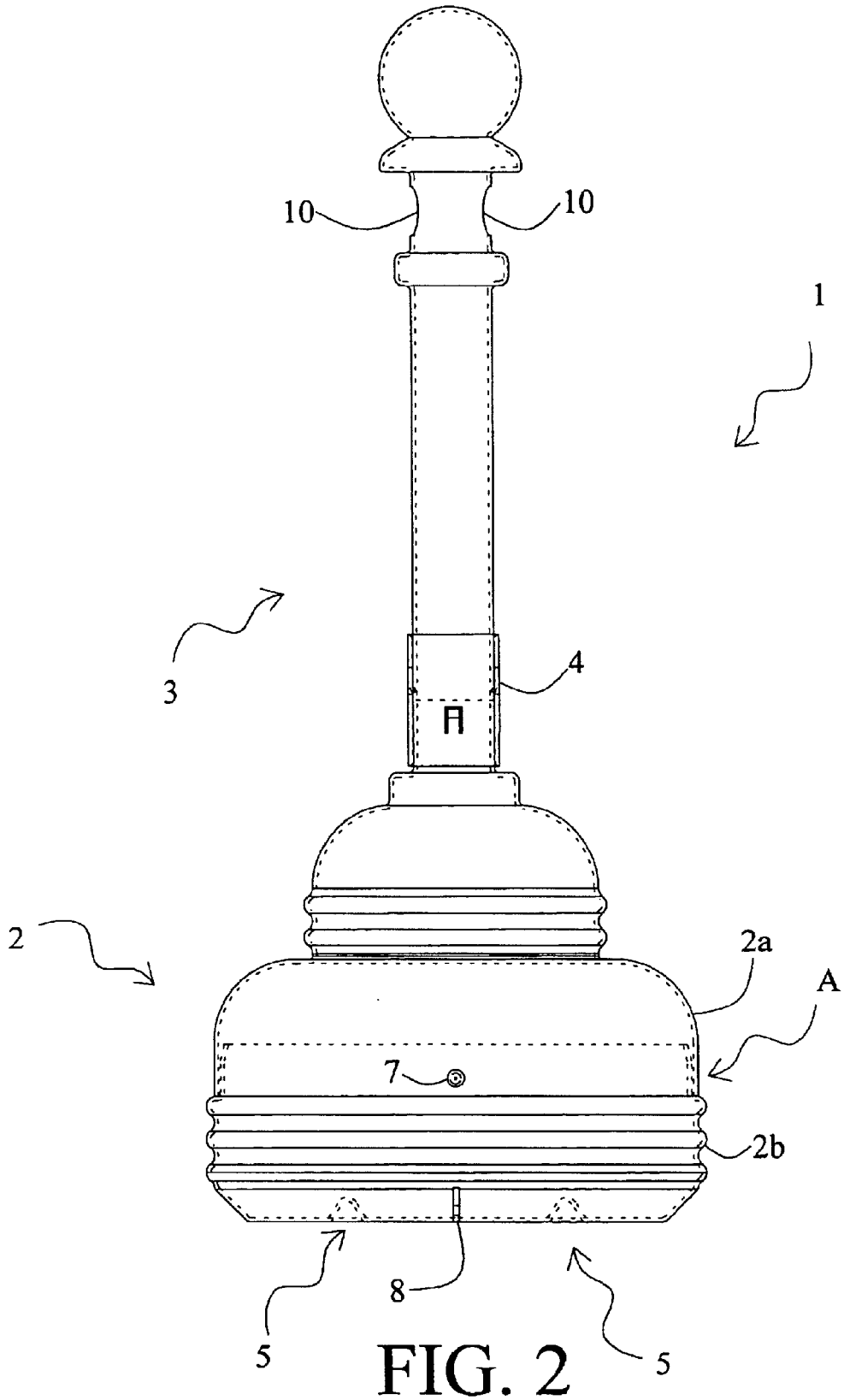
FIG. 2 is a side view of the repository of the present invention.

FIGS. 1 and 2 depict a spent-cigarette repository of the invention. The repository 1 is made up of a base 2, a column 3, and a connector 4. In a preferred embodiment the base 2 has two sections, removable lid portion 2*a* and bottom portion 2*b*, with the lid portion overlapping the bottom portion at (A) when assembled. By providing the base with a removable top portion, emptying the repository of spent smoking materials is facilitated. A metal container (not shown) can be provided inside the base to collect the smoking materials which are often lit and hot. Molded protrusions 5 can be provided for centering the metal container. In order to secure the lid portion 2*a* of the base to the bottom portion 2*b* of the base, nuts 6 attached to the bottom portion and threaded members 7 can be provided, with the threaded members being arranged to pass through holes in the lid portion to engage the nuts. As shown in FIGS. 1 and 2 at numerical indicators 8, the bottom portion 2*b* of the base can include flanges 8 having holes 9 for tethering the spent-cigarette repository to a stationary object so as to prevent its theft, if desired.

The column 3 is preferably cylindrical at a lower portion thereof and decorative at an upper portion. The decorative portion is rounded or otherwise shaped so as to present surfaces which are not of danger to users or passerbys. FIG. 1 is a view of the front of the repository whereat a hole 10 is formed for use in depositing spent smoking material into the repository. A similar hole is preferably provided opposite hole 10 for the same purpose. Graphic instructions 11 can be provided near each hole for indicating where the spent smoking materials are to be deposited. A sphere-like upper end of the column facilitates moving the repository, which can be accomplished by lifting, or tilting the repository slightly and rolling it on a bottom periphery of the base. FIG. 2 depicts the same repository as FIG. 1 as viewed from a side (90° from FIG. 1) of the repository. In a preferred embodiment the base 2 and column 3 are fabricated of a plastic, such as polyethylene, with a wall thickness of between 3/32 and 5/32 of an inch.

Figure 3:
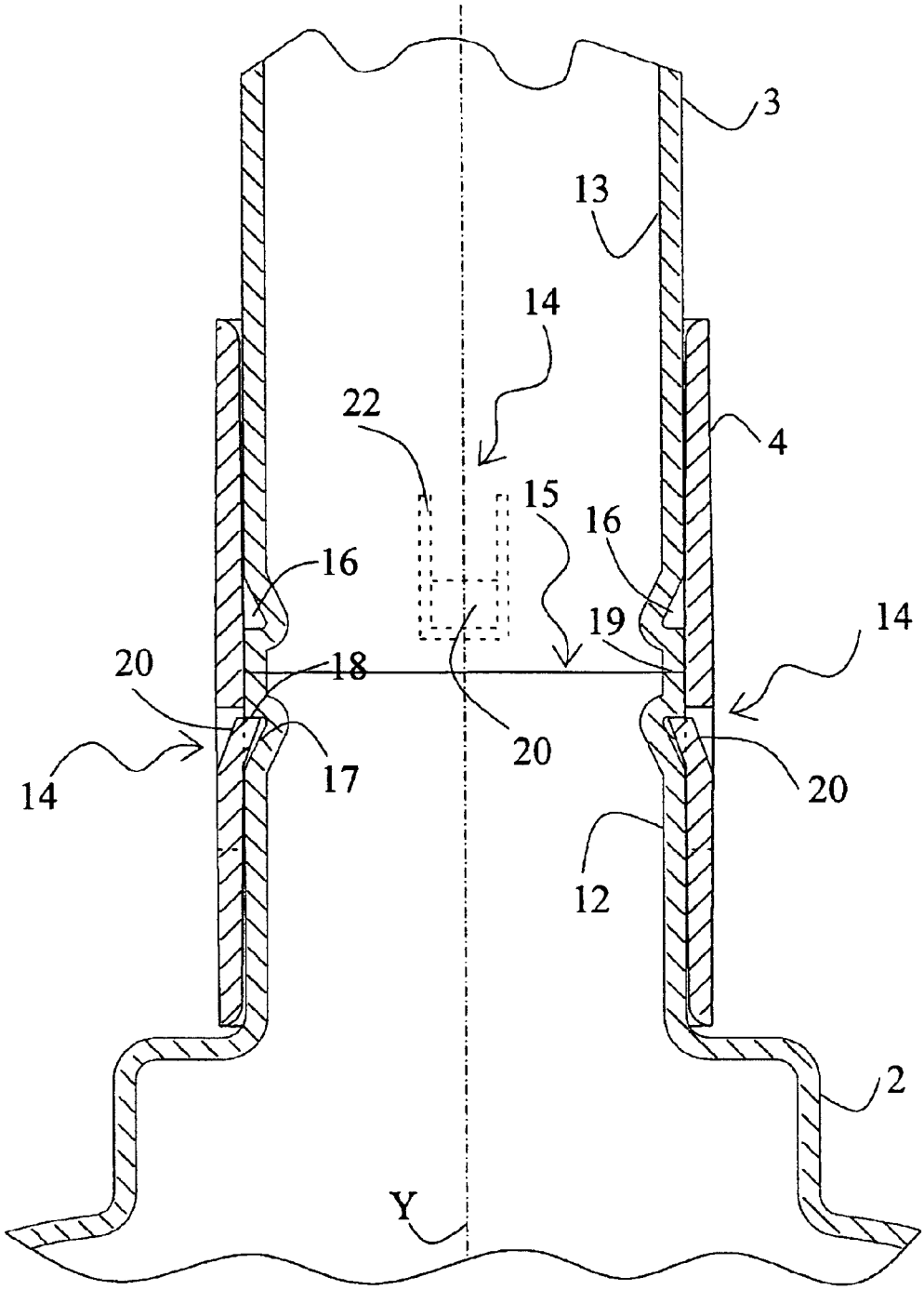
FIG. 3 is a cross-sectional view of a connector and connecting portions of the present invention in a vertical plane which includes a central axis of the repository and passes through connecting means on the sides of the repository.
Figure 4:
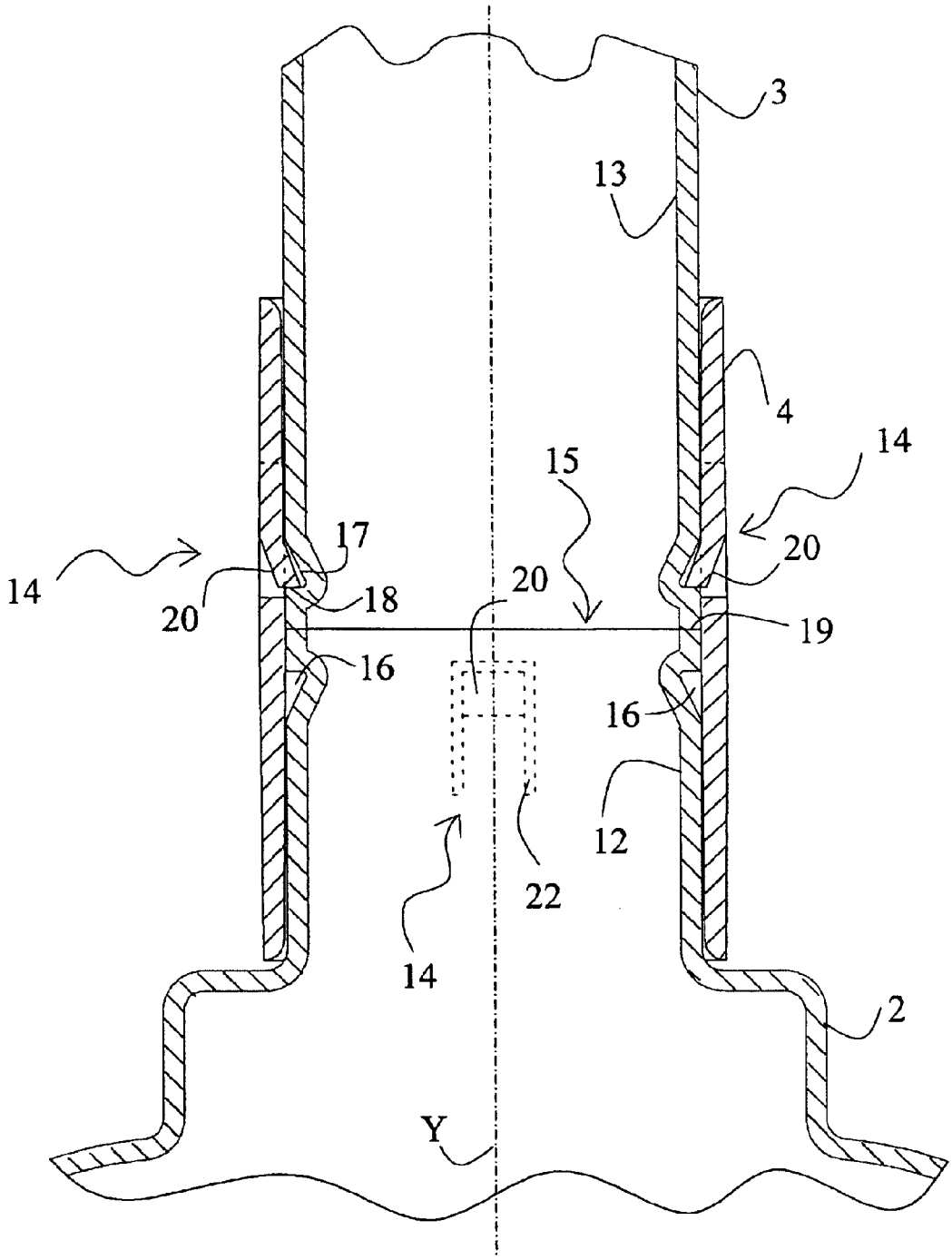
FIG. 4 is a cross-sectional view of the connector and connecting portions of the present invention in a vertical plane which includes a central axis of the repository and passes through connecting means on the front and rear of the repository.

Connector 4 of the repository slidingly engages a connecting portion 12 of the base which extends upwardly and a connecting portion 13 of the column. An enlarged cross-sectional view of the connector 4, connecting portion 12 of the base, and connecting portion 13 of the column, are shown in FIGS. 3 and 4. The cross-section is taken in a vertical plane which contains the central axis of the repository in both views, however, in FIG. 3 the plane passes through connecting clips 14, 14 at sides of the connector, and in FIG. 4 the plane passes through connecting clips 14, 14 at the front and the rear of the connector. References to the front, rear, and sides of the connector are only in relation to the connector as it is depicted with repository 1 of FIGS. 1 and 2, as the connector is rotatable around the connecting portions 12 and 13 of the base 2 and column 3 respectively, and the connector can be turned up-side down without changing the manner in which it functions.

The above-described versatility of the connector is enabled by the fact that the connecting portion 12 of the base 2 and the connecting portion 13 of the column 3, when in placement for connecting, are mirror-images of each other about a plane which is perpendicular to the central axis 14, at a location between the two connecting portions, which is indicated at 15 in FIGS. 3 and 4. Each of the connecting portions are provided with an inwardly extending circumferential groove 16 having a sloping wall 17 on one side of the groove, and a perpendicular wall 18 on the other side of the groove. On each piece (base and column) the perpendicular wall 18 is nearest ends 19, 19 of the connecting portions and has a substantially perpendicular relationship to the walls of the connecting portions. As best viewed in FIGS. 3 and 4, connecting clips 14 of the connector 4 have protruding tabs 20 which engage the side of groove 16 having the perpendicular wall, when the connecting portions are slid into connector 4. The engagement of tabs 20 against that side of the groove, locks the base 2 and the column 3 to connector 4, thus making a rigid unit which can be placed on a horizontal surface in a free-standing vertically oriented manner. In the preferred embodiment, the perpendicular wall 18 is perpendicular to the walls of the connecting portions, and the sloping wall 17 is at an angle of about 20° to 30° to the walls of the connecting portions. The perpendicular wall extends perpendicularly inward from the walls of the connecting portions a distance of about 0.10 inch.

Figure 5A:
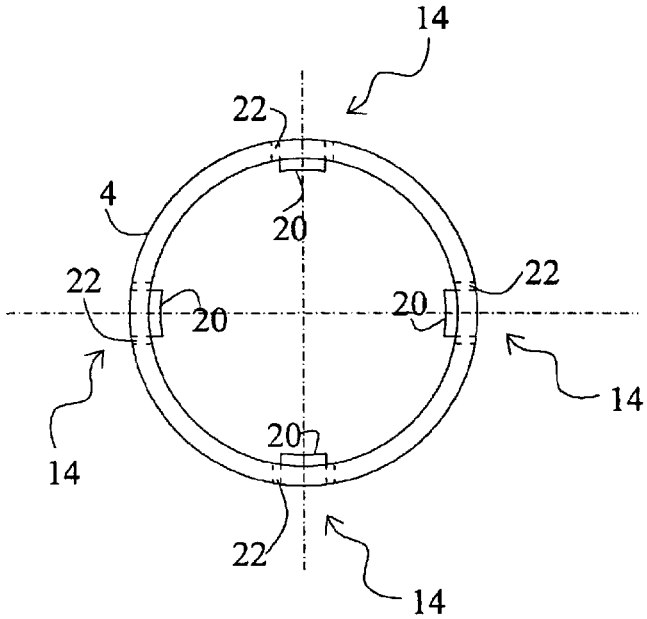
FIGS. 5*a* to 5*d* are various views of the connector of the invention, with FIG. 5*a* being a top view, FIG. 5*b* being a vertical cross-section in a plane through the connecting means of the connector, FIG. 5*c* being a front view, and FIG. 5*d* being a side view.
Figure 5B:
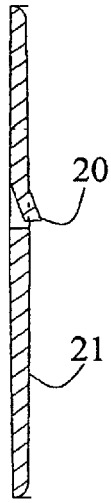
Figure 5C:
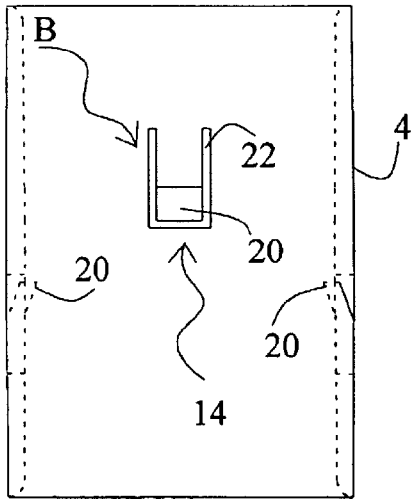
Figure 5D:
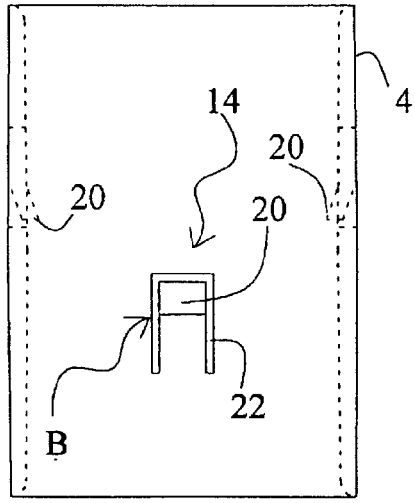

Connector 4 is shown in detail in FIGS. 5*a* to 5*d*. FIG. 5*a* is a top view of the connector showing a preferential disposition of connecting clips 14 which are spaced circumferentially 90° from each other. A vertical cross-sectional view of the wall of the connector, FIG. 5*b*, shows tab 20 which is formed to have an inward displacement from an inside wall surface 21 of the connector. In addition to the connecting clips 14 being displaced from each other 90° circumferentially, as shown in FIG. 5*a*, the connecting clips 14 are displaced in opposing pairs from a center in the axial directions of the connector as can be seen in front and side views 5*c* and 5*d* respectively. Also, one pair is oriented in a reverse direction to the other pair, in relation to the axis. In a preferred embodiment the connector 4 is molded of a plastic, for example polyethylene, and has a side wall thickness of about 1/8 to 5/32 of an inch, and an axial length of 3 to 5 inches. An inside diameter is selected which provides a clearance between the connector 4 and the connecting portions 12 and 13 of about 0.003 of an inch. As best viewed in FIGS. 5*c* and 5*d* at (B), connecting clips 14 are separated from the remaining wall portions of the connector in a "U" shaped manner by separation 22. The separation provides flexibility to protruding tabs 20 so as to facilitate connecting. In the preferred embodiment the width of the separation is approximately 1/16 of an inch, and the protruding tab 20 projects inward beyond the inside wall of the connector about 0.10 of an inch.

The connector and the connecting portions of the base and the column are arranged such that when the connecting portion of the base is butted against the connecting portion of the column, one opposing pair of connecting clips 14 is in alignment with groove 16 of the base, and the other opposing pair of connecting clips 14 is in alignment with groove 16 of the column, as shown in FIGS. 3 and 4. As shown in FIGS. 3 and 4 the end of each tab 20 rests against the perpendicular wall 18 of each groove.

Figure 6:
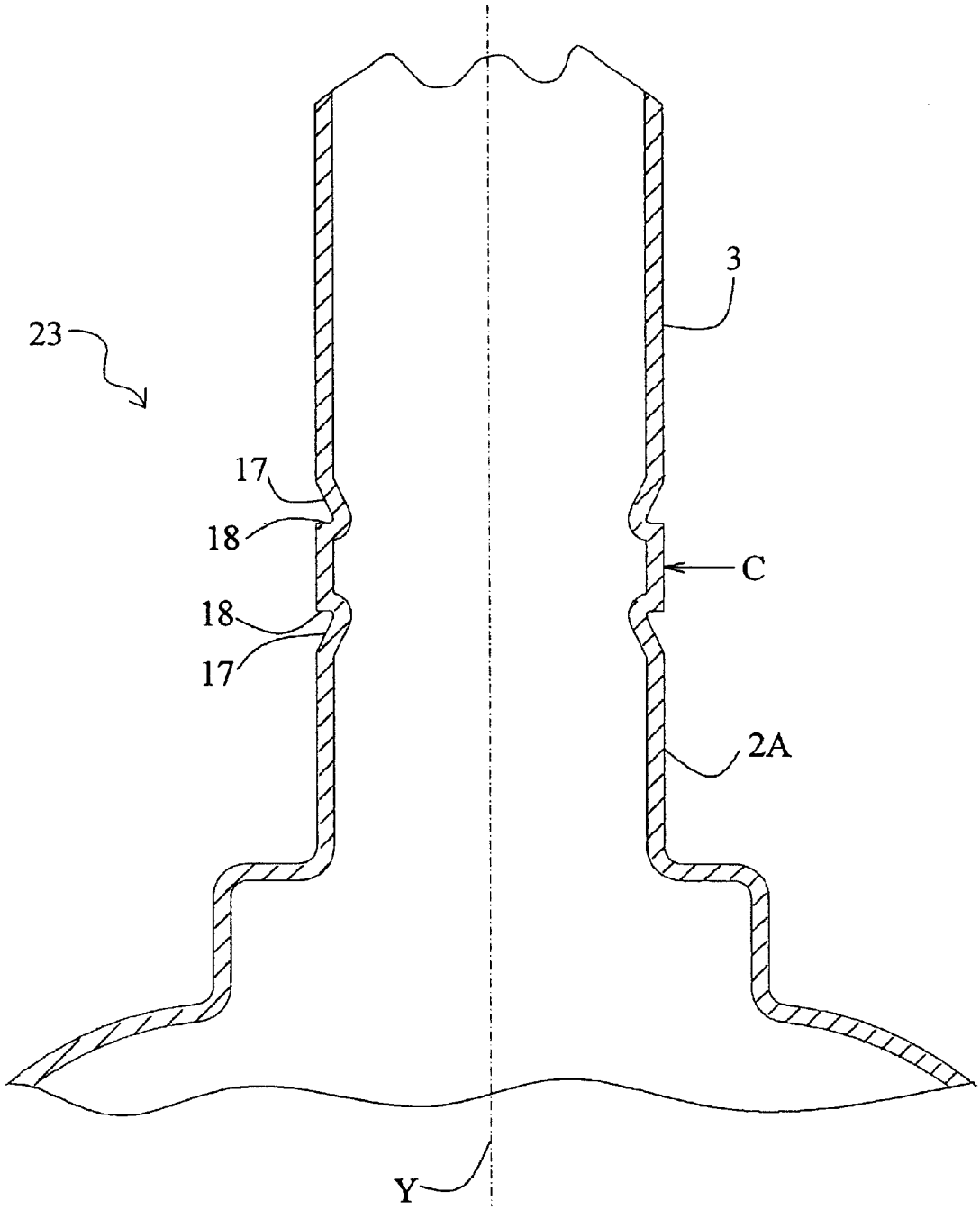
FIG. 6 is a vertical cross-section in a plane which includes the central axis of a single-piece molded article at a portion which is severed to produce a base and a column of the invention.
Figure 7:
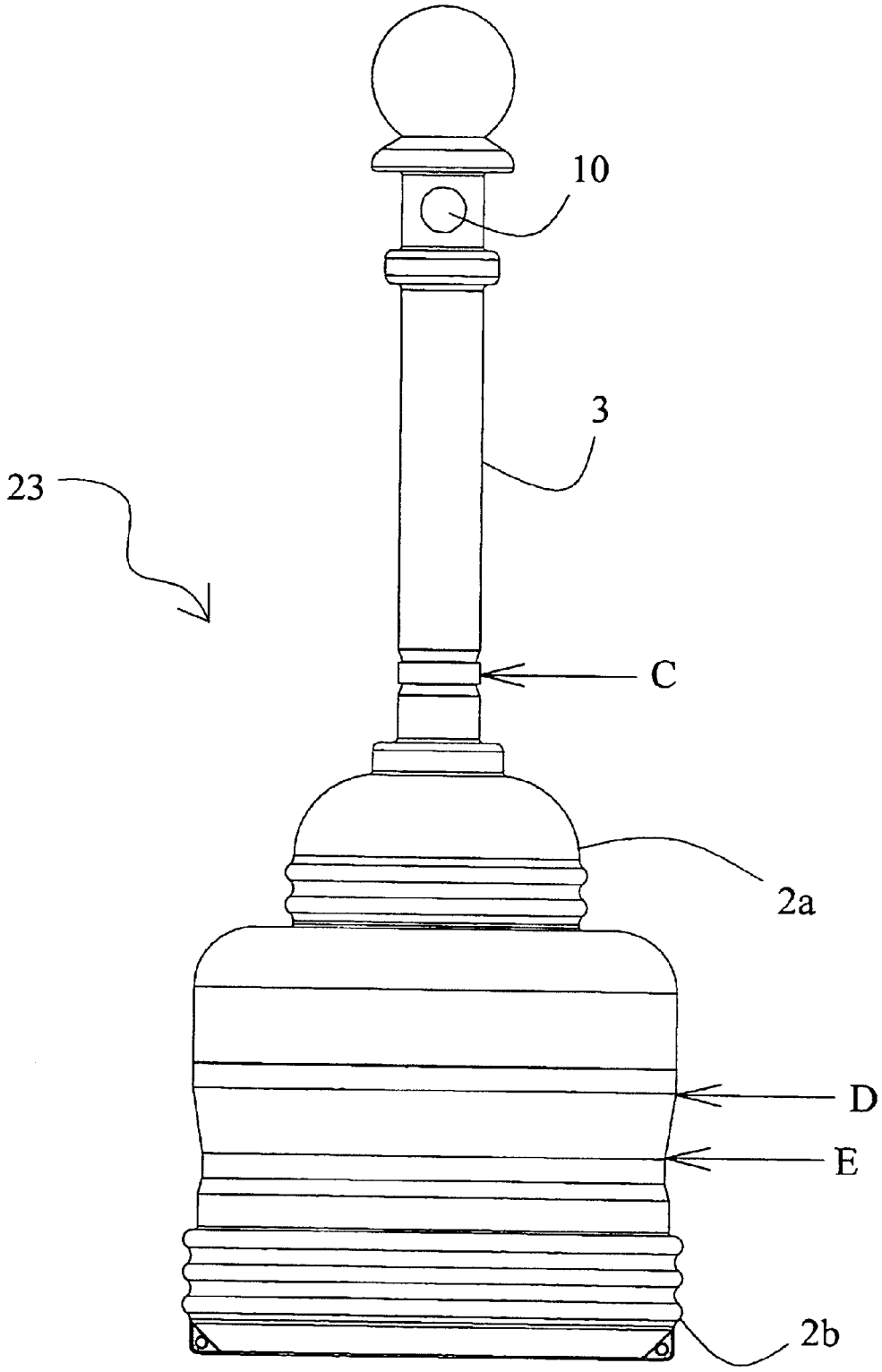
FIG. 7 is a front view of the single-piece molded article of FIG. 6, in its entirety.

In a method of fabricating the base and the column of the invention, a single piece 23 is molded as partially shown in FIG. 6 and shown in its entirety in FIG. 7. In the molded piece the connecting portion 12 of base 2 and the connecting portion 13 of column 3 are integral at (C), thus requiring a single mold and a single molding operation. In a step following removal of the single piece from the mold, a severing operation is carried out to sever the connecting portions at (C). The single molded piece is severed in a manner such that newly formed ends of the connecting portions of the base and the column are an equal distance in the axial direction from the grooves of the connecting portions. That is, the connecting portions have a mirror image of each other in a plane in which the connecting portions abut each other. In the preferred embodiment of the invention the single piece is produced by blow molding.

In a further molding efficiency, as shown in FIG. 7, the base, which in the preferred embodiment is openable, is molded as part of the single piece, with a transition portion, as shown between (D) and (E) in FIG. 7. The single piece is molded so as to have an inside diameter at (D) which is slightly larger than an outside diameter at (E) so that following severing at (D) and (E) the lid portion 2*a* of the base can fit snugly over the bottom portion 2*b* of the base.

By providing the spent-cigarette repository configured and fabricated as described, costs associated with packaging, storing and shipping can be reduced.

While specific materials, dimensional data, processing and fabricating steps have been set forth for purposes of describing the invention, various modifications can be resorted to in light of the above teachings without departing from the novel contributions; therefore in determining the scope of the present invention, reference shall be made to the appended claims.

What is claimed is:

1. A repository for spent smoking materials, comprising a base for supporting said repository in a free-standing upright orientation on a horizontal surface and having a connecting portion, a hollow column arranged to extend upwardly from said base, said hollow column being a separate piece from said base and having a connecting portion, and a connector for slidingly engaging said base and said hollow column at the connecting portions so as to connect said base and said hollow column in a rigid manner, wherein said base and said hollow column connecting portions abut each other, the connecting portions being mirror images of each other in a plane between said base connecting portion and said column connecting portion, each said connecting portion includes a circumferential groove for engaging said connector so as to prevent movement of each connecting portion in the connector in the direction of slidingly engaging, and the connector includes connecting clips having protruding tabs for mating with the circumferential groove of each connecting portion.

2. The repository of claim 1, wherein each circumferential groove has a perpendicular wall extending substantially perpendicular to the wall of the connecting portion, each protruding tab of the connector has an end oriented substantially perpendicular to the wall of the connector, and during connecting engagement the perpendicular wall and the tab end oppose each other to prevent axial movement of the connecting portions in the connector.

3. The repository of claim 1, wherein said connecting clips have resiliency in a direction perpendicular to the wall of the connector provided by a separation between the clip and the remaining wall of the connector.

4. The repository of claim 1, wherein said column includes an end portion closing off a top end of the column, and said column includes at least one aperture for use in depositing material into said repository.

5. The repository of claim 1, wherein said base is comprised of a bottom portion and a removable lid portion which includes said connecting portion.

6. The repository of claim 1, wherein material of said base, column, and connector is polyethylene, a wall thickness of said base and column is between about 3/32 and 5/32 of an inch, and a wall thickness of said connector is between about 1/8 and 5/32 of an inch.

* * * * *